US005688368A

United States Patent [19]

Luthi

[11] Patent Number: 5,688,368

[45] Date of Patent: Nov. 18, 1997

[54] METHOD FOR COOLING AND OZONE BLEACHING WOOD PULP

[75] Inventor: Oscar Luthi, Nashua, N.H.

[73] Assignee: Beloit Technologies, Inc., Wilmington, Del.

[21] Appl. No.: 535,363

[22] Filed: Sep. 28, 1995

Related U.S. Application Data

[63] Continuation of Ser. No. 164,868, Dec. 10, 1993, abandoned.

[51] Int. Cl.[6] ..... D21C 9/153

[52] U.S. Cl. ..... 162/56; 162/65

[58] Field of Search ..... 162/65, DIG. 12, 162/54, 56, 60, 24

[56] References Cited

U.S. PATENT DOCUMENTS 2,721,356 10/1955 Litvan et al. ..... 162/DIG. 12
3,963,561 6/1976 Richter ..... 162/65
4,088,529 5/1978 Ryhman et al. ..... 162/DIG. 12
4,450,044 5/1984 Fritzold et al. ..... 162/65

FOREIGN PATENT DOCUMENTS

WO94/10376 5/1994 WIPO ..... 162/65

*Primary Examiner*—Steven Alvo
*Attorney, Agent, or Firm*—Dirk J. Veneman; Raymond W. Campbell

[57] ABSTRACT

A method and apparatus for cooling wood pulp, coming from a high temperature bleaching stage at a consistency of approximately 10%, prior to introducing the wood pulp to a low temperature bleaching stage, including the steps of exposing the pulp to a thickening press in order to extract sufficient liquor from the pulp to increase the consistency to more than 25%; fluffing the pulp and depositing it on a moving bed cooler having a provision for blowing air through the pulp; and blowing cooling air through the pulp by using an air pump device with appropriate ducting. By first thickening the pulp, the mass of pulp to be cooled is significantly reduced and energy savings proportionate to the mass reduction are realized.

1 Claim, 5 Drawing Sheets

AIR TEMPERATURES 'F

AIR FLOW

AT BOUNDARY

AT THICKNESS

| H INCH | 0.0 | 1.0 | 2.0 | 3.0 | 4.0 | 5.0 | 6.0 | 7.0 | 8.0 | 9.0 | 10.0 |
|---|---|---|---|---|---|---|---|---|---|---|---|
| 0.000 | 100.0 | 100.0 | 100.0 | 100.0 | 100.0 | 100.0 | 100.0 | 100.0 | 100.0 | 100.0 | 100.0 |
| 1.200 | 114.5 | 109.8 | 106.4 | 104.0 | 102.5 | 101.5 | 100.9 | 100.5 | 100.3 | 100.2 | 100.1 |
| 2.400 | 123.0 | 116.7 | 111.6 | 107.8 | 105.2 | 103.3 | 102.1 | 101.4 | 100.9 | 100.5 | 100.3 |
| 3.600 | 128.8 | 121.8 | 115.9 | 111.3 | 107.8 | 105.3 | 103.6 | 102.4 | 101.6 | 101.0 | 100.7 |
| 4.800 | 133.2 | 125.9 | 119.6 | 114.4 | 110.4 | 107.4 | 105.1 | 103.5 | 102.4 | 101.6 | 101.1 |
| 6.000 | 136.7 | 129.2 | 122.7 | 117.2 | 112.8 | 109.4 | 106.8 | 104.8 | 103.4 | 102.3 | 101.6 |
| 7.200 | 139.6 | 132.1 | 125.4 | 119.8 | 115.1 | 111.4 | 108.4 | 106.1 | 104.4 | 103.2 | 102.2 |
| 8.400 | 142.0 | 134.5 | 127.8 | 122.1 | 117.2 | 113.2 | 110.0 | 107.5 | 105.6 | 104.1 | 102.9 |
| 9.600 | 144.0 | 136.6 | 130.0 | 124.1 | 119.2 | 115.0 | 111.6 | 108.9 | 106.7 | 105.0 | 103.7 |
| 10.800 | 145.8 | 138.5 | 131.9 | 126.0 | 121.0 | 116.7 | 113.2 | 110.3 | 107.9 | 106.0 | 104.5 |
| 12.000 | 147.4 | 140.2 | 133.6 | 127.8 | 122.7 | 118.4 | 114.7 | 111.6 | 109.1 | 107.0 | 105.4 |

BED LENGTH (FEET)

PULP FLOW

AVERAGE AIR EXHAUST TEMPERATURE 121.6

Fig. 3A

PULP TEMPERATURES °F

AIR FLOW

AT BOUNDARY

| H INCH | 0.0 | 1.0 | 2.0 | 3.0 | 4.0 | 5.0 | 6.0 | 7.0 | 8.0 | 9.0 | 10.0 |
|---|---|---|---|---|---|---|---|---|---|---|---|
| 0.000 | 180.0 | 148.4 | 128.4 | 116.4 | 109.2 | 105.1 | 102.8 | 101.5 | 100.8 | 100.4 | 100.2 |
| 1.200 | 180.0 | 152.3 | 133.7 | 121.5 | 113.6 | 108.5 | 105.3 | 103.3 | 102.0 | 101.3 | 100.8 |
| 2.400 | 180.0 | 155.6 | 138.2 | 126.0 | 117.6 | 111.7 | 107.8 | 105.1 | 103.3 | 102.2 | 101.4 |
| 3.600 | 180.0 | 157.9 | 141.6 | 129.7 | 121.0 | 114.7 | 110.2 | 107.0 | 104.8 | 103.2 | 102.2 |
| 4.800 | 180.0 | 159.7 | 144.3 | 132.7 | 124.0 | 117.4 | 112.5 | 108.9 | 106.3 | 104.4 | 103.0 |
| 6.000 | 180.0 | 161.1 | 146.6 | 135.3 | 126.6 | 119.9 | 114.7 | 110.8 | 107.8 | 105.6 | 104.0 |
| 7.200 | 180.0 | 162.3 | 148.4 | 137.5 | 128.9 | 122.1 | 116.8 | 112.6 | 109.4 | 106.9 | 105.0 |
| 8.400 | 180.0 | 163.2 | 150.0 | 139.5 | 131.0 | 124.2 | 118.7 | 114.3 | 110.9 | 108.2 | 106.1 |
| 9.600 | 180.0 | 164.1 | 151.4 | 141.2 | 132.9 | 126.1 | 120.5 | 116.0 | 112.4 | 109.5 | 107.2 |
| 10.800 | 180.0 | 164.8 | 152.7 | 142.7 | 134.9 | 127.8 | 122.2 | 117.6 | 113.9 | 110.8 | 108.3 |
| 12.000 | 180.0 | 165.5 | 153.8 | 144.2 | 136.2 | 129.5 | 123.9 | 119.2 | 115.3 | 112.1 | 109.5 |
| TP AV | 180.0 | 159.9 | 144.9 | 133.7 | 125.3 | 119.0 | 114.2 | 110.6 | 107.9 | 105.8 | 104.3 |

BED LENGTH (FEET)

BED HEIGHT (INCH)

PULP FLOW

AVERAGE PULP TEMPERATURE

Fig. 3B

CONSISTENCIES % O.D.

AIR FLOW

IN FIRST ELEMENT

| H INCH | 0.0 | 1.0 | 2.0 | 3.0 | 4.0 | 5.0 | 6.0 | 7.0 | 8.0 | 9.0 | 10.0 |
|---|---|---|---|---|---|---|---|---|---|---|---|
| 0.600 | 45.0 | 45.9 | 46.5 | 46.8 | 47.0 | 47.2 | 47.2 | 47.3 | 47.3 | 47.3 | 47.1 |
| 1.800 | 45.0 | 45.8 | 46.4 | 46.7 | 47.0 | 47.1 | 47.2 | 47.3 | 47.3 | 47.4 | 47.4 |
| 3.000 | 45.0 | 45.7 | 46.3 | 46.6 | 46.9 | 47.1 | 47.2 | 47.3 | 47.3 | 47.4 | 47.4 |
| 4.200 | 45.0 | 45.7 | 46.2 | 46.5 | 46.8 | 47.0 | 47.1 | 47.2 | 47.3 | 47.4 | 47.4 |
| 5.400 | 45.0 | 45.6 | 46.1 | 46.5 | 46.7 | 46.9 | 47.1 | 47.2 | 47.3 | 47.3 | 47.4 |
| 6.600 | 45.0 | 45.6 | 46.1 | 46.4 | 46.7 | 46.9 | 47.0 | 47.1 | 47.2 | 47.3 | 47.4 |
| 7.800 | 45.0 | 45.6 | 46.0 | 46.3 | 46.6 | 46.8 | 47.0 | 47.1 | 47.2 | 47.3 | 47.3 |
| 9.000 | 45.0 | 45.5 | 46.0 | 46.3 | 46.5 | 46.8 | 46.9 | 47.1 | 47.2 | 47.2 | 47.3 |
| 10.200 | 45.0 | 45.5 | 45.9 | 46.2 | 46.5 | 46.7 | 46.9 | 47.0 | 47.1 | 47.2 | 47.3 |
| 11.400 | 45.0 | 45.5 | 45.9 | 46.2 | 46.5 | 46.7 | 46.8 | 47.0 | 47.1 | 47.2 | 47.3 |
| CP AV | 45.00 | 45.65 | 46.12 | 46.46 | 46.72 | 46.91 | 47.05 | 47.16 | 47.24 | 47.30 | 47.34 |

PULP FLOW

AVERAGE PULP CONSISTENCIES

Fig. 3C

METHOD FOR COOLING AND OZONE BLEACHING WOOD PULP

This application is a continuation of application Ser. No. 08/164,868, filed Dec. 10, 1993 now abandoned.

BACKGROUND OF THE INVENTION

This invention relates generally to bleaching of wood pulp, and, more particularly to cooling of pulp between high temperature and low temperature bleaching stages.

Pulp bleaching is usually accomplished in a sequence of bleaching stages. For example, one common bleaching sequence starts with an oxygen or chlorine dioxide stage, followed by an ozone stage, which is followed by another chlorine dioxide stage. Generally, the oxygen and chlorine dioxide stages require pulp temperatures of 65 degrees to 80 degrees celsius at a pulp consistency of about 10%. The ozone stage temperature is ideally less than 40 degrees celsius with a pulp consistency of 45%. Thus, it is easily seen that a very large quantity of heat must be removed from the pulp slurry prior to its introduction into the ozone bleaching stage. To some extent this is due to the requirement for acidifying the pulp prior to ozone bleaching. This requirement favors dilution of the pulp to lower the consistency to approximately 4% by weight of oven dried pulp in order to make mixing more uniform.

Generally, after the acid has been added, the pulp at 4% consistency is processed in a thickening press to increase the consistency to the desired 45% range for ozone bleaching. The liquor thus extracted is directed to a cooling tower in which its temperature is reduced from 40 degrees celsius to approximately 25 degrees celsius. After cooling, liquor is recycled to the vessel in which the acid is added to the pulp where it is used to dilute the 10% consistency pulp to 4% consistency while also reducing the pulp temperature from 65 degrees celsius to 40 degrees celsius. Of course, after the ozone stage is completed, the pulp must be reheated prior to a following chlorine dioxide or oxygen bleaching stage. This is accomplished by adding steam together with excess liquor, coming from the thickening press at 40 degrees celsius, to reduce the pulp consistency to approximately 10% while increasing its temperature to the 65 degrees celsius to 80 degrees celsius temperature required.

The cooling and heating just described consumes great quantities of energy as well as time. The result is a reduction of pulp production capacity and an increase in operating cost.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a method for cooling wood pulp coming from a high temperature bleaching stage at a consistency of approximately 10%, prior to introducing the pulp to a low temperature bleaching stage, including the steps of extracting sufficient liquor from the wood pulp to increase its consistency to more than 25%; fluffing the pulp and depositing the fluffed pulp on a moving bed cooler having provision for blowing air through the pulp; and blowing cooling air through the pulp until the temperature has been reduced to that required by the low temperature bleaching stage.

The foregoing and other aspects will become apparent from the following detailed description of the invention when considered in conjunction with the accompanying drawing figures.

BRIEF DESCRIPTION OF THE DRAWING FIGURES

FIGS. 3*a*, 3*b*, and 3*c* are tabulations which illustrate distribution of air temperature, pulp temperature, and pulp consistency within a pulp bed on a moving bed cooler.

DETAILED DESCRIPTION

Figure 1:
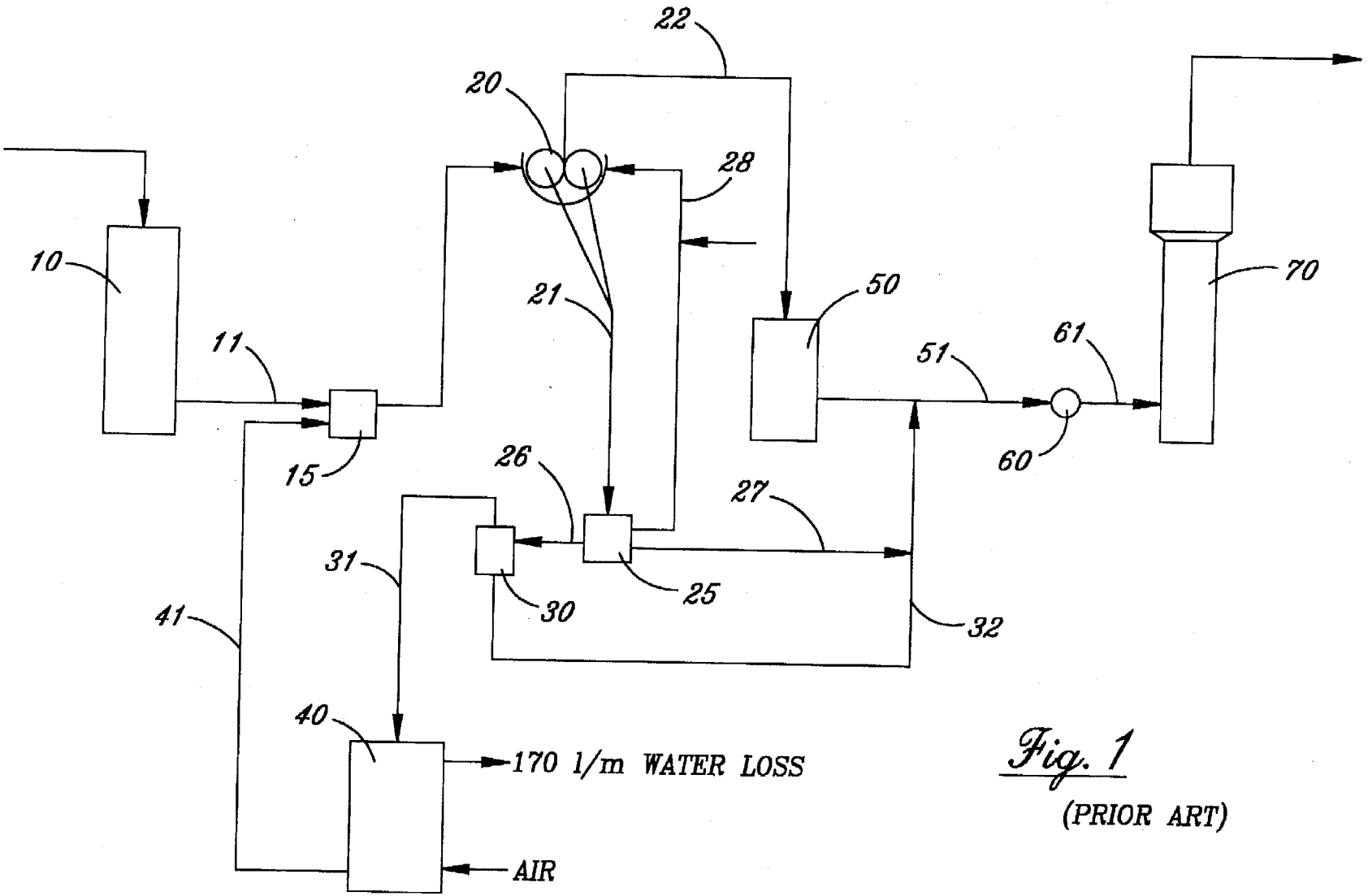
Fig. 1 (PRIOR ART)
FIG. 1 is a schematic representation of a commonly employed bleaching sequence in a pulp mill.

FIG. 1 schematically illustrates a three stage bleaching sequence in a pulp processing operation. Holding tank 10 receives pulp at 10% consistency and 65 degrees celsius from an oxygen or chlorine dioxide bleaching stage. The pulp flows through pipe 11 into mixing tank 15 in which acid together with liquor from pipe 41 is added to acidify the pulp, to reduce its consistency to approximately 4%, and to lower its temperature to 40 degrees celsius. Dilution to 4% consistency aids in achieving thorough mixing of the acid with the pulp, and, by diluting with cooled liquor at about 25 degrees celsius, it also cools the pulp to the desired temperature.

The pulp is then fed through pipe 16 to thickening press 20 in which sufficient liquor is removed to increase the consistency of the pulp to at least 25%, but preferably 45%, before feeding it through pipe 22 to the ozone bleaching stage 50. The liquor from thickening press 20 flows through pipe 21 into holding tank 25, then through pipe 26 into Fibersaver® screening machine 30, and then through pipe 31 to cooling tower 40 in which it is cooled to 25 degrees celsius for use as needed in mixing tank 15.

Meanwhile, pulp from the ozone stage 50 feeds through pipe 51 to mixer 60 in which steam and liquor from pipes 27 and 32 are introduced to the pulp to reduce the consistency to approximately 10% and to reheat the pulp to approximately 65 degree celsius prior to entering chlorine dioxide stage 70 through pipe 61. The energy consumption for heating and cooling the pulp liquor is very great. For example, at a production rate of 550 metric tons per day of oven dried pulp, the feed to the holding tank 10 will consist of 550 metric tons of pulp together with 4,950 metric tons of liquor. At this rate, after dilution to a consistency of 10.5 percent, more than 3,000 liters per minute of liquor will be flowing through pipe 51. Just to heat that amount of liquor the required 25 degrees celsius requires 75 million calories per minute. From this it is clear that prior art bleaching sequences are very energy intensive.

Figure 2:
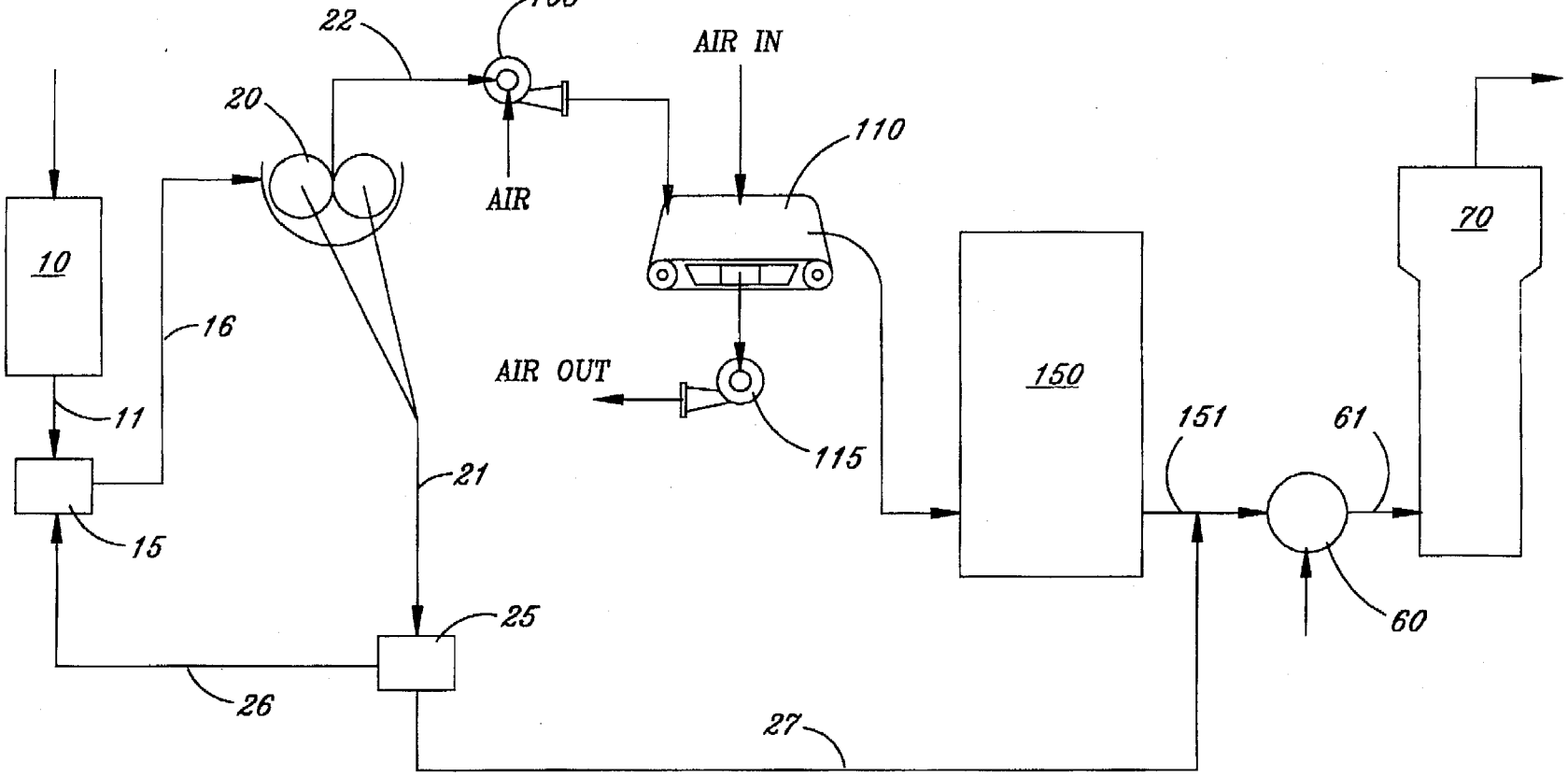
FIG. 2 is a schematic representation of the same sequence as in FIG. 1, this time incorporating the method and apparatus of the present invention.

Referring to FIG. 2, a bleaching sequence as in FIG. 1 is shown; however, the present invention is incorporated to cool the pulp prior to the ozone bleaching stage 150. In this case holding tank 10 receives pulp at 10% consistency and 65 degrees celsius from a chlorine dioxide or oxygen bleaching stage. The pulp is fed through pipe 11 to mixing tank 15 in which the pulp is diluted to 4% consistency and is acidified. The acidified pulp, still at 65 degrees celsius, is discharged through pipe 16 to thickening press 20. Here sufficient liquid is extracted to increase the pulp consistency to at least 25% and preferably to 45% or more. The extracted liquor passes through pipe 21 to holding tank 25 from which, as needed, it can be fed through pipe 26 to mixing tank 15 for dilution of incoming pulp. The thickened pulp, still at 65 degrees celsius, is discharged through pipe 22 into fluffer 105. After fluffing, the pulp is deposited in a substantially uniform bed on a moving bed cooler 110 which is equipped with fans 115 or other provision for blowing air through the pulp bed on the moving bed cooler to cool it to 40 degrees celsius as required by ozone stage 150. Upon completion of the bleaching reaction in ozone stage 150, the pulp is discharged through pipe 151 to mixer 60. Liquor from holding tank 25 is fed through pipe 27 into mixer 60 to dilute the pulp to approximately 10% consistency. Since the dilution liquor is still at 65 degrees celsius, after dilution the temperature of the diluted pulp is approximately 62 degrees celsius. Thus, it is only necessary for the steam injection into the mixer 60 to raise the temperature of the pulp by 3 degrees celsius. When compared to the situation in FIG. 1, it is clear that, for the same production rate as discussed with respect to FIG. 1, the heat input will only be 9 million calories per minute as compared to 75 million calories per minute for the system of FIG. 1. This is a saving of approximately 88 percent of the energy previously required. In addition, the reheating of the pulp prior to the chlorine dioxide stage 70 will be accomplished in a small fraction of the time required for reheating the pulp in the system of FIG. 1.

FIGS. 3*a*, 3*b*, and 3*c* are calculated distributions of pulp characteristics within the pulp bed on the moving bed cooler 110. These figures are based on an example of 550 metric tons oven dry pulp per day at 45% consistency and 180 degrees fahrenheit (or 80 degrees celsius). The bed thickness is 12 inches, and it is spread on a 3 foot by 10 foot porous surface moving at 70 feet per minute. The bed surface may be a woven screen formed as an endless belt on drive rolls or any suitable open member driven by any appropriate means. The cooling air is at 100 degrees fahrenheit and 100% humidity with a velocity of 15 ft. per second downward through the pulp bed. Under these operating conditions, the calculated values for air temperature, FIG. 3*a*, are shown to range from 147.4 degrees fahrenheit to 105.4 degrees fahrenheit with an average exhaust temperature of 121.6 degrees fahrenheit. In FIG. 3*b*, the pulp temperature as a function of location in the bed varies between 180 degrees fahrenheit and 100.2 degrees fahrenheit with an average temperature at discharge of 104.3 degrees fahrenheit (40 degrees celsius). Pulp consistency, as a function of location in the bed, is shown in FIG. 3*c*. With a beginning consistency of 45% the discharge consistency, as expected, will average 47.34% at the end of the moving bed cooler.

Considering FIGS. 3*a*, 3*b*, and 3*c*, the downflow of the cooling air, and the characteristics of high consistency pulp, the results described are reasonable and expected. Thus, since the coolest air contacts the top of the pulp bed first, it is expected that air temperature and pulp temperature would be at their lowest at the top of the pulp bed and at their highest at the bottom of the bed. Since the bed is moving from left to right in the figures, air temperature and pulp temperature would also be expected to decrease from the zero foot location to the ten foot location on the moving bed cooler. The consistency of the pulp displays, in FIG. 3*c*, an increase from the zero foot location to the ten foot location on the moving bed cooler. In considering these figures, it should be remembered that the evaporative cooling which accompanies the increase in pulp consistency in FIG. 3*c* also assists in reduction of the pulp temperature in FIG. 3*b*. Note that these results are obtained with air at 100 degrees fahrenheit and 100% relative humidity. By dehumidifying the air or by refrigerating the air, the cooling and consistency increasing effects will be intensified.

The results shown here are for downward air flow through the pulp bed. Different results would be obtained with upward air flow through the bed because such upward air flow would tend to lift the pulp rather than compacting the pulp as in the downflow case. Using upward air flow, however, involves the risk of blowing the pulp off the moving bed cooler if the air flow is not accurately controlled.

It is clear that, by extracting liquor prior to reduction of temperature of the pulp to the ozone bleaching temperature, a great deal of reheating energy is conserved as well as a great deal of refrigeration energy which might otherwise be needed. In the present invention, this waste is avoided as well as the excessive pollution which accompanies large volumes of cooling air flow.

What is claimed is:

1. A method for processing wood pulp, the wood pulp having an elevated temperature, said method comprising the following steps:

introducing the elevated temperature wood pulp into a mixing tank;

introducing a first dilution liquor into the mixing tank, the first dilution liquor having an elevated temperature approximately the same as the wood pulp elevated temperature;

mixing the elevated temperature wood pulp and the elevated temperature first dilution liquor in the mixing tank;

extracting sufficient elevated temperature liquor from the elevated temperature wood pulp to increase consistency of said pulp to more than 25%;

dividing the extracted elevated temperature liquor into two portions, one portion being the first dilution liquor and the other portion being a second dilution liquor, both portions having an elevated temperature approximately the same as the wood pulp elevated temperature;

fluffing the elevated temperature wood pulp and depositing the elevated temperature wood pulp on a moving bed cooler having a provision for blowing air through the wood pulp;

blowing cooling air through the wood pulp to reduce the temperature of the wood pulp;

ozone bleaching the reduced temperature wood pulp; and diluting the bleached reduced temperature pulp with the elevated temperature second dilution liquor to raise the temperature of the bleached pulp.

* * * * *